US007149462B2

(12) United States Patent
Kawamura et al.

(10) Patent No.: US 7,149,462 B2
(45) Date of Patent: Dec. 12, 2006

(54) CONTAINER, TONER CONTAINER, IMAGE FORMING APPARATUS, AND IMAGE FORMING PROCESS

(75) Inventors: Yoshihide Kawamura, Numazu (JP); Fumio Ogata, Fuji (JP); Masato Suzuki, Numazu (JP); Masahiro Nakayama, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 105 days.

(21) Appl. No.: 11/013,425

(22) Filed: Dec. 17, 2004

(65) Prior Publication Data

US 2005/0196198 A1 Sep. 8, 2005

(30) Foreign Application Priority Data

Dec. 17, 2003 (JP) ..... 2003-419614

(51) Int. Cl.
*G03G 15/08* (2006.01)

(52) U.S. Cl. ..... 399/262; 222/DIG. 1; 399/260

(58) Field of Classification Search ..... 399/260, 399/262, 263, 258; 222/DIG. 1
See application file for complete search history.

(56) References Cited

U.S. PATENT DOCUMENTS 5,557,382 A * 9/1996 Tatsumi et al. ..... 399/262
6,088,561 A 7/2000 Kawamura et al.
6,104,900 A 8/2000 Ishikawa et al.
6,134,411 A * 10/2000 Meyer et al. ..... 399/262
6,336,020 B1 1/2002 Ishikawa et al.
6,934,495 B1 * 8/2005 Yoshino et al. ..... 399/262

* cited by examiner

*Primary Examiner*—Hoang Ngo
(74) *Attorney, Agent, or Firm*—Oblon, Spivak, McClelland, Maier & Neustadt, P.C.

(57) ABSTRACT

The present invention relates to a container containing a toner that exhibits sufficient sealing effects and prevents leakage of the content in the container body.

The container according to the present invention comprises a container body having a pipe-like aperture, an inner cap fitted to inner side of the aperture in an attachable and detachable fashion, and an outer cap fitted to outer side of the aperture in an attachable and detachable fashion, wherein the aperture is equipped with a first convex that projects ring-wise from the inner side of the aperture and a sealing face that is situated at tip side of the aperture, wherein the inner cap is equipped with a second convex and a resilient sealing portion, the second convex projects ring-wise from the outer side of the inner cap and has an outer diameter larger than the inner diameter of the first convex, the resilient sealing portion contacts with the sealing face resiliently from outside of the aperture to urge the inner cap in a direction so that the second convex presses the first convex, and wherein the outer cap is equipped with a pressing portion that presses the resilient sealing portion so as to move the inner cap to a position where the pressing are released between the first convex and the second convex.

22 Claims, 9 Drawing Sheets

CONTAINER, TONER CONTAINER, IMAGE FORMING APPARATUS, AND IMAGE FORMING PROCESS

BACKGROUND OF THE INVENTION

1. Field of the Invention

The present invention relates to containers, toner containers containing a toner, and, image forming apparatuses and image forming processes that utilize the toner container.

2. Description of the Related Art

Toner containers containing a toner (hereinafter referring to as "toner containers"), utilized for electrophotographic image forming apparatuses such as copiers, printers and facsimiles, are typically equipped with an inner cap fitted to inner side of an aperture that is provided in the main body of the toner container and also equipped with an outer cap fitted to outer side of the aperture that fits to the inner cap (see Japanese Patent Application Laid-Open (JP-A) Nos. 10-111596 and 2003-84553, for example). In the toner containers, the size of outer diameter of the inner cap and the size of inner diameter of the aperture are produced in almost the same size, thus fitting and fixing of the inner cap to the inner side of the aperture is performed by making use of the resilience of the inner cap.

When the toner containers are attached to inside of an image forming apparatuses, the outer cap is removed from the toner container, and the toner container fitted with the inner cap is installed to predetermined position in the image forming apparatus. Then, the fitting of the inner cap is spontaneously released by action of an attaching-detaching mechanism, and the toner container without the fitting of the inner cap is driven to rotate around the center axis of the toner container, thereby the toner contained in the toner container is discharged from the aperture and the toner is supplied to the image forming portion in the image forming apparatus. The inner cap, of which the fitting is released by action of the attaching-detaching mechanism, remains the condition being supported by the attaching-detaching mechanism, and is fitted again to the inside of the aperture when the toner container is removed from the image forming apparatus after the toner in the toner container is consumed or depleted. Consequently, the leakage of a minor mount of the toner that remains within the toner container may be prevented when detaching the toner containers from the image forming apparatuses.

Such inner caps of the toner containers are usually formed of plastic material, and are typically fitted to toner containers with a fitting force of 1 to 3 kgf. When inner caps of plastic material are subjected a fitting force for long period, the inner caps typically undergo creep deformation, then the fitting force decreases against the aperture, and the inner caps turn into a loose condition. When the toner containers are installed to image forming apparatuses and the toner containers are inclined without outer caps in the loose condition, the inner caps often detach from the aperture, and the toner leaks from the toner containers in some cases.

When the inner caps are loose against the apertures, spaces may be induced between the inner caps and the apertures by a shock caused by dropping the toner container for example, the toner possibly leaks from the space, and the leaked toner tends to reside between the aperture and the outer cap. The condition that toner resides between the aperture and the outer cap may possibly cause smears through dispersing the toner when removing the outer cap. Moreover, the toner between the apertures and the outer caps tend to turn into granulates through flocculating, thus causing a problem of inferior image quality since images are formed from such toner granulates.

SUMMARY OF THE INVENTION

The object of the present invention is to provide containers in which the content such as a toner is prevented from leakage when the inner cap and the outer cap are fitted to the aperture of the main body of the container (hereinafter referring to "container body" or "main body") as well as when the inner cap is solely fitted to the aperture of the main body without the outer cap, and toner containers (containers containing a toner), and, image forming apparatuses and image forming processes that utilize the container and the toner container respectively.

The container according to the present invention comprises a container body having a pipe-like aperture, an inner cap fitted to inner side of the aperture in an attachable and detachable fashion, and an outer cap fitted to outer side of the aperture in an attachable and detachable fashion, wherein the aperture is equipped with a first convex that projects ring-wise from the inner side of the aperture and a sealing face that is situated at tip side of the aperture, wherein the inner cap is equipped with a second convex and a resilient sealing portion, the second convex projects ring-wise from the outer side of the inner cap and has an outer diameter larger than the inner diameter of the first convex, the resilient sealing portion contacts with the sealing face resiliently from outside of the aperture to urge the inner cap in a direction so that the second convex presses the first convex, and wherein the outer cap is equipped with a pressing portion that presses the resilient sealing portion so as to move the inner cap to a position where the pressing are released between the first convex and the second convex.

In accordance with the container of the present invention, an inner cap is fitted to inner side of the aperture and an outer cap is fitted to outer side of the aperture; then a resilient sealing portion of the inner cap that contacts with the sealing face of the aperture is pressed and compacted or thinned by the pressing portion of the outer cap; thereby the sealing ability between the sealing face and the resilient sealing portion is enhanced, the leakage of the content in the container body may be effectively prevented. At this stage, the inner cap moves toward far side of the aperture since the resilient sealing portion is pressed, thus the contacting and fitting of the side of second convection and the side of the first convection is released.

When the fitting of the outer cap is released, the resilient sealing portion that is compacted or thinned by the action of pressing portion recovers from the compacted or thinned condition; the resilient force of the recovered sealing portion urges the inner cap to move and the side of the second convex and the side of the first convex are contacted and pressed.

Thus, the second convection does not undergo creep deformation when the outer cap is fitted, and releasing of the fitting of the outer cap leads to sufficient sealing effect between the side of second convex and the side of the first side, thereby the content may be prevented from leakage out of the aperture of the container body.

The container containing a toner according to the present invention comprises a container body having a pipe-like aperture, an inner cap fitted to inner side of the aperture in an attachable and detachable fashion, and an outer cap fitted to outer side of the aperture in an attachable and detachable fashion, wherein the toner is filled into the container body, wherein the aperture is equipped with a first convex that projects ring-wise from the inner side of the aperture and a sealing face that is situated at tip side of the aperture, wherein the inner cap is equipped with a second convex and a resilient sealing portion, the second convex projects ring-wise from the outer side of the inner cap and has an outer diameter larger than the inner diameter of the first convex, the resilient sealing portion contacts with the sealing face resiliently from outside of the aperture to urge the inner cap in a direction so that the second convex presses the first convex, and wherein the outer cap is equipped with a pressing portion that presses the resilient sealing portion so as to move the inner cap to a position where the pressing are released between the first convex and the second convex.

In accordance with the toner container of the present invention, an inner cap is fitted to inner side of the aperture and an outer cap is fitted to outer side of the aperture; then a resilient sealing portion of the inner cap that contacts with the sealing face of the aperture is pressed and compacted or thinned by the pressing portion of the outer cap; thereby the sealing ability between the sealing face and the resilient sealing portion is enhanced, the leakage of the content of toner in the container body may be effectively prevented. At this stage, the inner cap moves toward far side of the aperture since the resilient sealing portion is pressed, thus the contacting and fitting of the side of second convection and the side of the first convection is released.

When the fitting of the outer cap is released, the resilient sealing portion that is compacted or thinned by the action of pressing portion recovers from the compacted or thinned condition; the resilient force of the recovered sealing portion urges the inner cap to move and the side of the second convex and the side of the first convex are contacted and pressed.

Thus, the second convection does not undergo creep deformation when the outer cap is fitted, and releasing of the fitting of the outer cap leads to sufficient sealing effect between the side of second convex and the side of the first side, thereby the content of toner may be prevented from leakage out of the aperture of the container body.

The image forming apparatus according to the present invention comprises a photoconductor, a latent electrostatic image forming unit configured to form an electrostatic image on the photoconductor, a developing unit configured to develop the latent electrostatic image by means of a toner to form a visible image, a transferring unit configured to transfer the visible image on a recording medium, and a fixing unit configured to fix the transferred image on the recording medium, wherein the toner is supplied from the toner container according to the present invention.

In the image forming apparatus according to the present invention, the leakage of toner may be effectively prevented when the toner container is installed to the image forming apparatus, and also smears due to the leaked toner inside the apparatus may be effectively prevented.

The image forming process according to the present invention comprises forming a latent electrostatic image on a photoconductor surface, developing the latent electrostatic image to form a visible image by means of a toner, transferring the visible image on a recording medium, and fixing the image transferred on the recording medium, wherein the toner is supplied from the toner container according to the present invention.

In the image forming process according to the present invention, the leakage of toner may be effectively prevented when the toner container is installed to the image forming apparatus, and also smears due to the leaked toner inside the apparatus may be effectively prevented.

Figure 1:
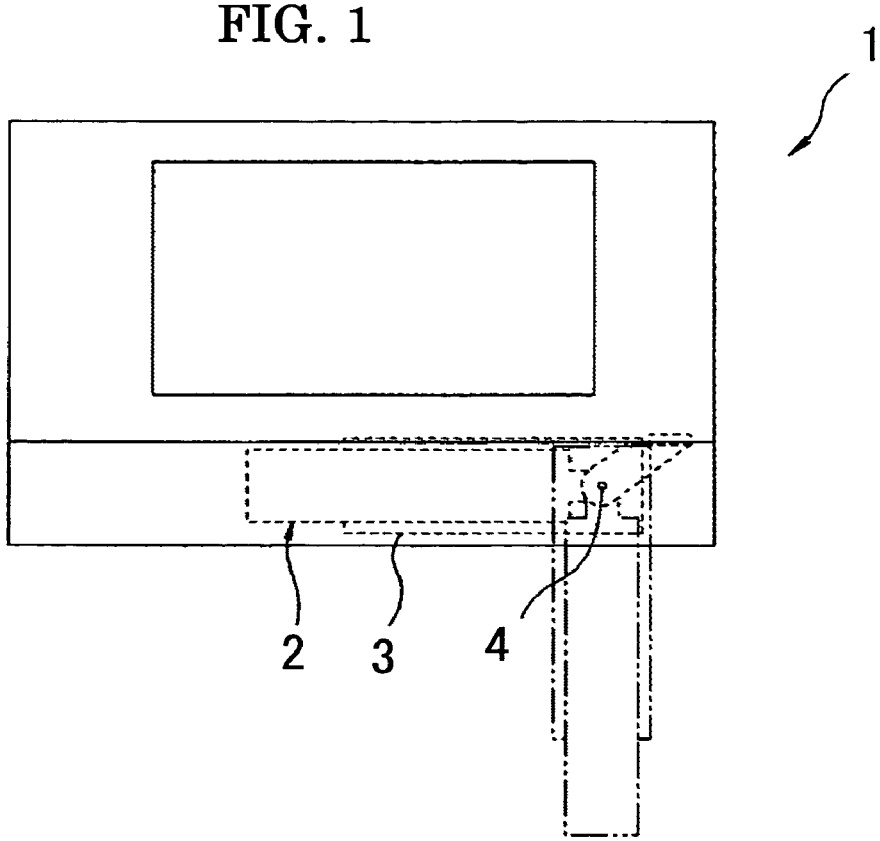
FIG. 1 is a schematic plan view showing exemplarily an entire construction of an image forming apparatus of the first aspect according to the present invention.

DESCRIPTION OF THE PREFERRED EMBODIMENTS (Container and Toner Container)

The container according to the present invention comprises a container body having a tube-like aperture, an inner cap fitted to the inner side of the aperture in an attachable and detachable fashion, an outer cap fitted to the outer side of the aperture in an attachable and detachable fashion, and the other units depending on the requirements.

The toner container according to the present invention contains a toner in the container according to the present invention, and comprises a container body having a tube-like aperture, an inner cap fitted to the inner side of the aperture in an attachable and detachable fashion, an outer cap fitted to the outer side of the aperture in an attachable and detachable fashion, and the other units depending on the requirements.

The container according to the present invention may be utilized in various technical fields; examples of the contents include powders for image forming, among these preferably are toners and developers.

The details of the toner container according to the present invention will be explained in the following along with the container according to the present invention.

The aperture portion comprises a first convex that projects ring-wise from the inner face of the aperture portion.

The inner cap is equipped with a second convex and a resilient sealing portion, the second convex projects ring-wise from the outer side of the inner cap and has an outer diameter larger than the inner diameter of the first convex, the resilient sealing portion contacts with the sealing face resiliently from outside of the aperture to urge the inner cap in a direction so that the second convex contacts and presses the first convex. The portion where the second convex contacts and presses the first convex is typically a band-like region along the circumstance of the second convex, the band-like region may be face-like with a substantial width or line-like with a considerably narrow width.

Preferably, the outer diameter "D" (mm) of the second convex and the inner diameter "d" (mm) of the first diameter satisfy the following relation: $0.05\ \text{mm} \leqq D-d \leqq 1.5\ \text{mm}$. This feature may assure to maintain the compressed size of the side of the second convection and the side of the first convection, thus the leakage of toner may be prevented when the outer cap is released, and further may suppress the force required to attach and detach the inner cap to and from the aperture, thus allowing smooth attachment and detachment of the inner cap to and from the aperture.

Preferably, at least one of the face of the second convex and the face of the first convex is formed into one of tapered face and round face. This feature may lead to easy tendency of deflection and deformation by the action of the pulling action, when the inner cap of which the side of the second convex contacts to the side of the first convex is pulled to release the fitting to the aperture so that the contacting force rises between the side of the second convex and the side of the first convex, thereby damages of aperture and inner cap may be prevented.

Preferably, the sealing face is formed of resilient material. Examples of the resilient material include urethanes, silicone elastomers. This feature may lead to the condition that the resilient sealing portion of inner cap cuts into the sealing face, thereby the sealing ability between the sealing face and the resilient sealing portion may be enhanced, and the leakage of toner from the aperture may be prevented more certainly.

Preferably, the inner cap is subjected to annealing. Preferably, the annealing is conducted at near and under the melting temperature of the material for a few minutes to a few hours. This feature may lead to higher resistance against creep deformation, in particular, the resilient force of the resilient sealing portion at recovering from the compressed or thinned condition comes to higher due to the lowered creep deformation, thus the contacting force comes to higher between the side of the second convex and the side of the first convex and the sealing effect also comes to higher, and the leakage of toner from the aperture of the toner container may be prevented more certainly.

Preferably, the aperture comprises a spacer member having the first convex. Examples of the material of the spacer member include polycarbonates. Separate formations of container body having the aperture and the spacer member having the first convex, followed by attachment of the spacer member to the aperture may bring about easy construction of the container. Further, since the dimensional accuracy of the first convection may be enhanced, the sealing ability may be improved when the side of the second convex is pressed, and the workability may be improved at attaching and detaching the inner cap. Further, the material margins of the main body and the spacer member with the first convex may be expanded, the toner leakage due to deformation and/or shrinkage of the first convex may be avoided by forming the spacer member with a material of higher hardness and less deformation, for example.

Preferably, the aperture comprises an enlarged aperture at the inner side that enlarges gradually toward the sealing face. This feature may make possible to guide the inner cap to the inner side of the aperture along the enlarged aperture when fitting the inner cap to the aperture.

Preferably, the inner cap comprises an anchor member that inhibits the inner cap, released from the aperture, to separate beyond a predetermined distance apart from the aperture by engaging with the edge of the aperture. Examples of the material of the anchor member include polypropylene. When the fitting of aperture to inner side is released by the attaching-detaching mechanism equipped in the image forming apparatus, the movement of the inner cap is inhibited to separate beyond a predetermined distance apart from the aperture, since the anchor member engages with the edge of the aperture, thus drop of the inner cap out of the main body may be prevented when the toner container is removed from the image forming apparatus after usage, thereby the inner cap may be certainly fitted to the aperture.

Preferably, the inner cap comprises a contacting piece, and the contacting piece contacts with the inner side of the aperture when the fitting of the inner cap to the aperture of the container body installed to an image forming apparatus is released by an attaching-detaching mechanism of inner cap provided in the image forming apparatus.

When toner container is installed into the image forming apparatus and the fitting of inner cap to aperture is released by attaching-detaching mechanism, and toner container is rotated around the centerline of toner container in order to feed the toner to the developing portion of the image forming apparatus, the contacting piece that contacts with inner side of aperture relatively contacts and slides with the inner side of aperture, thus the toner on the inner side of aperture is scraped off. Consequently, the toner adhered on the inner side of aperture, which will be discarded in the prior art, may be decreased effectively.

The toner containers according to the present invention will be explained more specifically in terms of the various aspects with reference to the figures.

<First Aspect>

Figure 2:
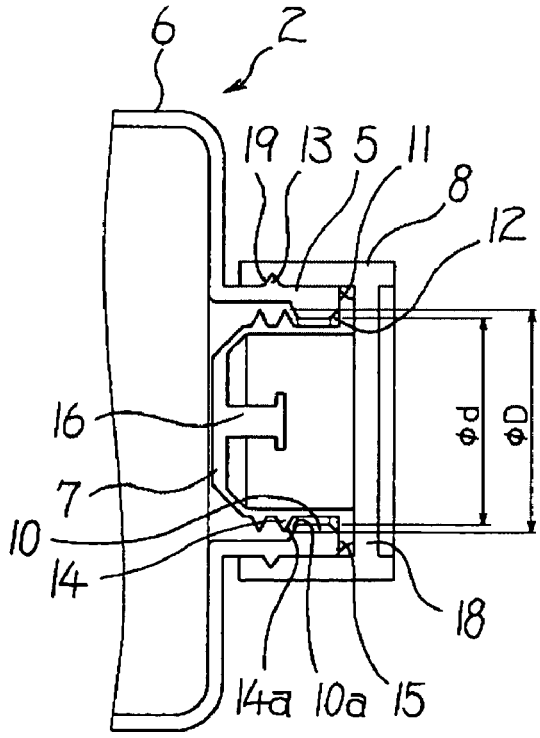
FIG. 2 is a longitudinal front section of an exemplary toner container, in which an inner cap and an outer cap are fitted to an aperture.
Figure 3:
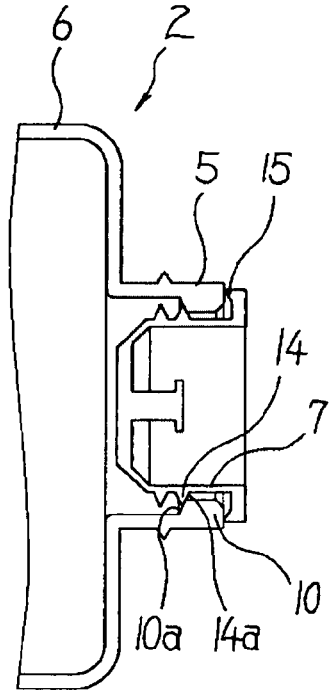
FIG. 3 is a longitudinal front section of an exemplary toner container, in which an inner cap is fitted to an aperture without an outer cap.

The first aspect of the present invention will be explained with reference to FIGS. 1 to 4. FIG. 1 is a schematic plan view showing exemplarily an entire construction of the image forming apparatus; FIG. 2 is a longitudinal front section of an exemplary toner container, in which an inner cap and an outer cap are fitted to the aperture; FIG. 3 is a longitudinal front section of an exemplary toner container, in which an inner cap is fitted to the aperture without an outer cap; and FIG. 4 is a longitudinal front section showing a condition that an inner cap is unfixed or released from an aperture by means of an attaching-detaching device mounted in the copier.

Copier 1, being one of image forming apparatuses, is equipped with an image forming portion (not shown) that performs image forming based on electrophotography. Holder 3 to which toner container 2 may be mounted in an attachable and detachable fashion is provided to the copier, wherein the toner container contains a toner for supplying to the developing portion of the image forming apparatus. Holder 3 is provided to the image forming apparatus in a rotatable fashion within approximately horizontal plane by means of supporting pin 4 as the supporting point, and is rotatable between the toner-supplying position indicated by broken line and attaching and detaching portion indicated by alternate long and two short dashes line in FIG. 1. Holder 3 is rotated to the attaching and detaching portion indicated by alternate long and two short dashes line and the toner container 2 containing a toner is attached to holder 3, then holder 3 is rotated and moved to the toner-supplying position indicated by broken line, thereby the toner filled in the toner container 2 may be supplied to the developing portion of the image forming portion.

Figure 4:
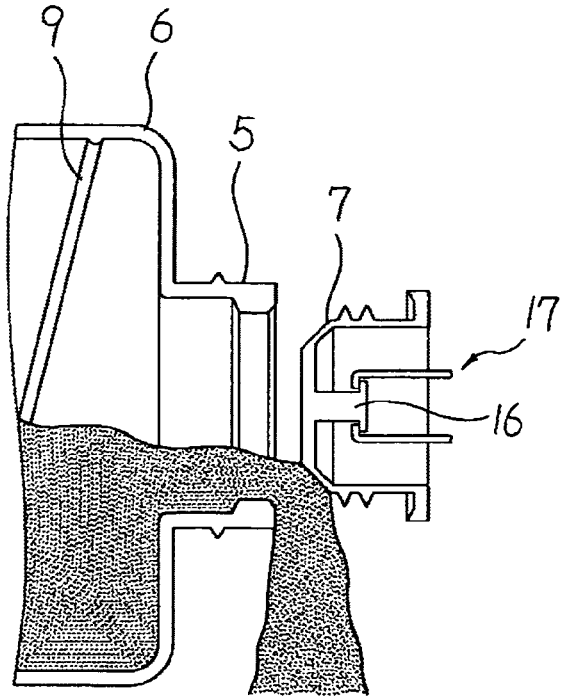
FIG. 4 is a longitudinal front section showing a condition that an inner cap is released from an aperture by means of an attaching-detaching mechanism provided in the copier.

Toner container 2 comprises, as shown in FIGS. 2 to 4, container body 6 that is equipped with a tube-like aperture portion 5 at one end and is sealed at the other end, an inner cap 7 fitted to the inner side of aperture 5 in an attachable and detachable fashion, and an outer cap 8 fitted to the outer side of aperture 5 in an attachable and detachable fashion. As for the materials of these parts, toner container 2 is polyester, inner cap 7 is polyethylene, and outer cap 8 is polypropylene.

Spiral projection 9 is provided on the inner side of main body 6 that directs the contained toner toward aperture 5 when toner container 2 attached to main body 6 is rotated around the centerline such that the centerline is substantially horizontal. Further, a guiding slope (not shown) is provided for guiding the toner, which is directed toward aperture 5 by spiral projection 9, from the bottom of inner side of the main body 6 to aperture portion 5 along with the revolution of main body 6 around the centerline. The guiding slope is particularly valuable when the amount of toner remaining in main body 6 comes to less. The formation of spiral projection 9 and the guiding slope may reduce remarkably the amount of toner remaining wastefully in main body 6.

Aperture 5 is formed integrally with main body 6; aperture is situated on the centerline of toner container 2 and formed with a diameter less than that of main body 6. First convex 10, sealing face 11, enlarged aperture 12, and screw portion 12 are provided in aperture 5.

The first convex 10 is ring-like that is formed on the inner side of aperture and projects from the inner side of the aperture; first convex 10 is designed as "d" mm of the inner diameter.

Sealing face 11 is ring-like that is formed at tip side of aperture; the resilient sealing portion of inner cap 7 contacts to sealing face 11, when inner cap 7 is fitted to aperture 5. Enlarged aperture 12 is provided at inner side of aperture 5 and is formed taper-wise such that the diameter enlarges gradually toward sealing face 11.

Screw portion 13 is provided at outer side of aperture 5. By engaging screw portion 13 and screw of outer cap 8, outer cap 8 can be fitted to the outer side of aperture 5.

Inner cap 7 is a part that is fitted to the inner side of aperture in an attachable and detachable fashion. Second convex 14, resilient sealing portion 15, and gripping projection 16 are formed in the inner cap 7.

Second convex 14 is a ring-like part that is formed on the outer side of inner cap and project from the outer side. The outer diameter is designed to the size of "D" mm. The outer diameter "D" is designed in relation to inner diameter "d" mm of first convex as $0.05\ \text{mm} \leqq D-d \leqq 1.5\ \text{mm}$.

Resilient sealing portion 15 is a part that is contacted by sealing face 11 of aperture 5 from the outside of aperture when inner cap 7 is fitted to aperture 5. By contacting the resilient sealing portion 15 to sealing face 11, inner cap 7 is urged to the direction to which side 14*a* of the second convex is pressed to side 10*a* of the first convex 10 by the urging force of the resilient sealing portion 15 (see FIG. 3).

Side 14*a* of the second convex 14 and side 10*a* of the first convex 10 are each fabricated with tapered face. Alternatively, the tapered face may be a rounded face.

Gripping projection 16 is a part that is gripped by attaching-detaching mechanism 17 of inner cap provided in copier 1 as shown in FIG. 4 for attaching and detaching the inner cap 7 against aperture 5, after rotating and moving the holder 3 with toner container 2 to the toner-supplying position indicated by broken line of FIG. 1.

Further, the inner cap 7 is subjected to annealing after the fabrication. The annealing of inner cap may lead to higher resistance against creep deformation.

Outer cap 8 is a part that is fitted to the outer side of the aperture in an attachable and detachable fashion. Pushing portion 18 and screw portion 19 are provided to outer cap.

Screw portion 19 is provided at inner side of outer cap 8. By engaging screw portion 19 and screw portion 13 of aperture 5, outer cap 8 can be fitted to the outer side of aperture 5.

Pressing portion 18 presses and compacts or thins resilient sealing portion 15 such that inner cap 7 moves to the position where the pressing contact between side 14*a* of second convex 14 and side 10*a* of first convex 10 is released, when outer cap 8 fit with the outer side of aperture 5.

In such a construction of toner container 2, container body 6 is filled with a toner, then inner cap 7 is fitted to inner side of aperture 6 and outer cap 8 is fitted to outer side of aperture 5. Then, toner container 2 is transported and stored in a condition that inner cap 7 and outer cap 8 are fitted to aperture 5.

FIG. 2 shows the condition that inner cap 7 and outer cap 8 are fitted to aperture 5. Outer cap 8 fitted to the outer side of aperture 5 is engaged by screw portion 13 and screw portion 19; resilient sealing portion 15 of inner cap 7, which contact with sealing face 11 of aperture 5, is pressed and compacted or thinned by pressing portion 18 of outer cap. Resilient sealing portion 15 is pressed and compacted or thinned by pressing portion 18; thereby inner cap 7 that is fitted to the inner side of aperture 5 moves toward far part of aperture 5, and side 14*a* of second convex 14 and side 10*a* of first convex 10 are separated; consequently, the pressed contact is released between side 14*a* of second convex 14 and side 10*a* of first convex 10.

By the way, in the condition that outer cap 8 is fitted to outer side of aperture 5, the sealing effect due to contacting and pressing side 14*a* of second convex 14 and side 10*a* of first convex 10 cannot be taken; the leakage of toner in the container body 6 from aperture 5 can be prevented since resilient sealing portion 15 of inner cap 7 that contacts with sealing face 11 of aperture 5 is pressed and compacted or thinned by pressing portion 18 of outer cap 8.

When toner container 2 is installed to copier 1, outer cap 8 is removed from aperture 5 as shown in FIG. 3, toner container 2 with inner cap 7 fitted to aperture 5 is attached to holder 3 that is rotated and moved to the attaching and detaching portion indicated by alternate long and two short dashes line shown in FIG. 1, then holder 3 attached with toner container is rotated and moved to the attaching and detaching portion indicated by alternate long and two short dashes shown in FIG. 1.

By removing the fitting of outer cap 8 to aperture 5 as shown in FIG. 3, resilient sealing portion 15 pressed and compacted or thinned by pressing portion 18 recovers from the compacted or thinned condition, the resilient force of resilient sealing portion 15 urges to move inner cap 7 toward the opening of aperture 5, and side 14*a* of second convex 14 and side 10*a* of first convex 10 are contacted and pressed. Second convex 14 of inner cap 7 does not undergo creep deformation at the condition that outer cap 8 is fitted while the storage for example; therefore, sufficient sealing effect may be taken at the portions where side 14*a* of second convex 14 and side 10*a* of first convex 10 are contacted and pressed, thereby the leakage of toner in the toner container from aperture 5 can be prevented.

Incidentally, resilient sealing portion 15 of inner cap 7 may undergo creep deformation to some degree due to being pressed and thinned by pressing portion 18 for a long period, thus the resilient force acting on inner cap 7 decreases in the direction to contact and press side 14*a* of second convex 14 and side 10*a* of first convex 10; however, the resilient force is maintained that is required to contact and press side 14*a* of second convex 14 and side 10*a* of first convex 10.

Figure 5:
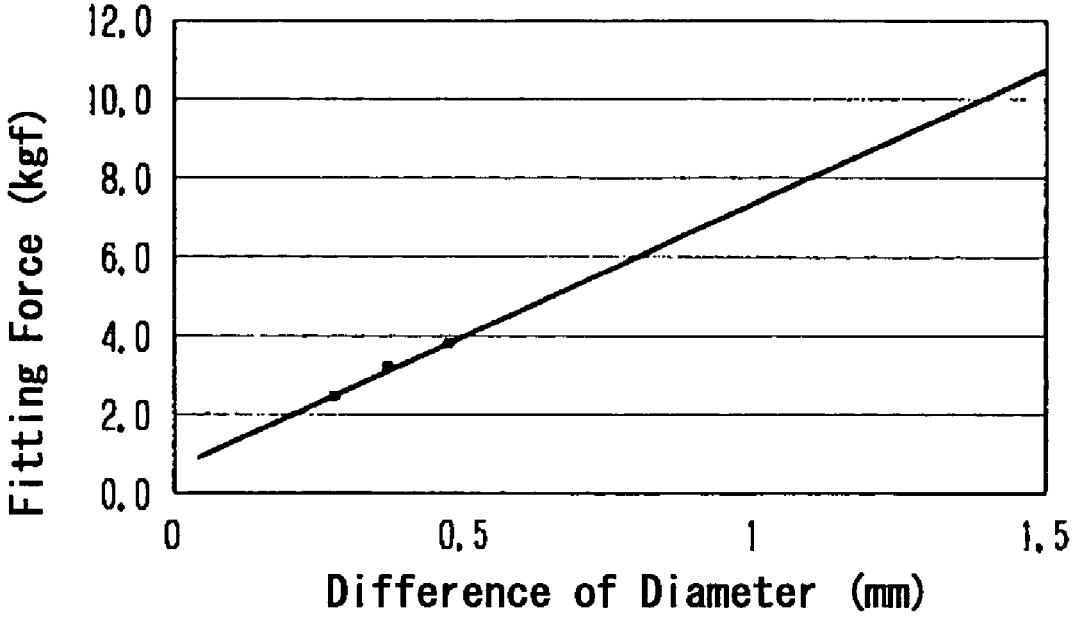
FIG. 5 shows the relation between the differences of outer diameter of the second convex and inner diameter of the first convex, and the fitting forces of the inner cap.

The experimental results with respect the relation between the force for releasing the fitting of inner cap 7 fitted to aperture 5 (fitting force of inner cap 7, kgf) and "D−d" are shown in FIG. 5, wherein "D" mm is outer diameter of second convex 14, "d" mm is inner diameter of first convex 10, and "D−d" is the difference between "D" and "d". As shown in FIG. 5, the larger is "D−d", the higher is the fitting force. The inner caps utilized in the experiments were formed of polyethylene, the thickness was 0.5 mm, and the inner cap was subjected to annealing at 95° C. for 75 seconds after its fabrication.

Figure 6:
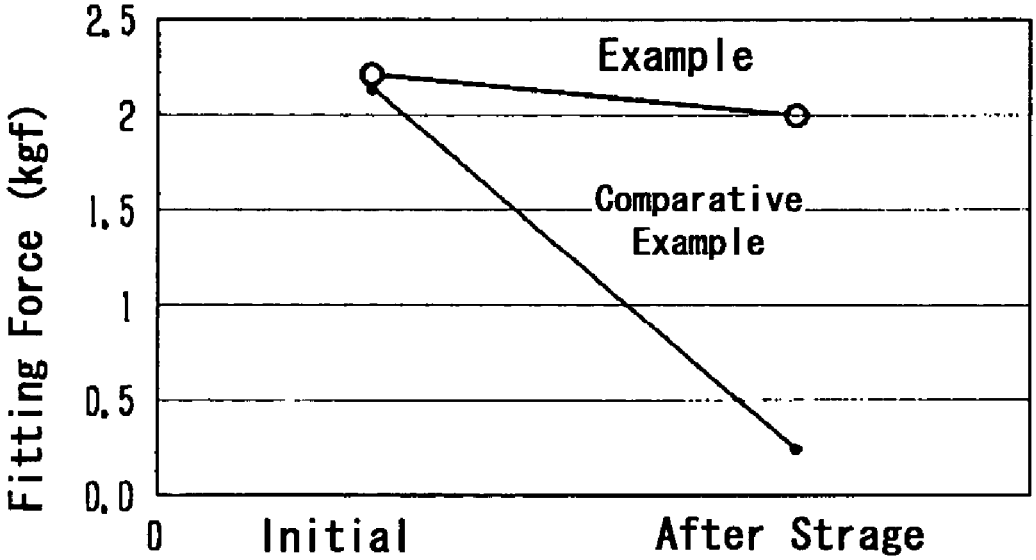
FIG. 6 is a graph showing decrease of fitting force by an inner cap due to creep deformation.

The experimental results will be explained in the followings with respect to decrease of fitting force of inner caps due to creep deformation with reference to FIG. 6, wherein the decrease of fitting force leads to decrease of sealing property. Experiments were conducted for toner containers of conventional construction and toner containers according to the present invention as follows: conventional toner containers and inventive toner containers were allowed to stand at 50° C. for 1 hour and then were allowed to stand at 55° C. for 1 hour, followed by removing the inner caps and measuring the fitting forces. In the experiments also, the utilized inner caps were formed of polyethylene, the thickness was 0.5 mm, and the inner cap was subjected to annealing at 95° C. for 75 seconds after its fabrication.

In the conventional toner containers, the fitting force was 2.06 kgf at the initial stage, whereas the fitting force was 0.22 kgf after the experimental condition. In the inventive toner containers, the fitting force was 2.16 kgf at the initial stage, whereas the fitting force was 1.96 kgf after the experimental condition.

When outer cap 8 is removed from aperture 5, toner container 2 is attached to holder 3, and holder 3 is rotated and moved to the toner-supplying position indicated by broken line shown in FIG. 1, then attaching-detaching mechanism 17 of inner cap in the copier is activated. Attaching-detaching mechanism 17 of inner cap grips gripping projection 16 of inner cap 7 and pulls toward outside of the aperture 5 as shown in FIG. 4, thereby fitting of inner cap 7 is released from aperture 5. Then, revolution of toner container 2 around its centerline may feed the toner inside the container body 6 to the developing portion from aperture 5 as shown in FIG. 4. When the fitting of aperture 5 is released by pulling inner cap 7, the tapered faces of side 14*a* of second convex 14 and side 10*a* of first convex 10 may lead to tendency of deflection and deformation by the action of the pulling action, thereby damages of aperture 5 and inner cap 7 may be prevented when inner cap 7 is removed from aperture 5. Accordingly, when inner cap 7 is fitted to aperture 5 for removing toner container 2 from holder 3, spill out of the remaining toner may be prevented from the fitting portion.

Inner cap 7 detached from aperture 5, while being gripped by attaching-detaching mechanism 17 of inner cap, maintains the condition gripped by attaching-detaching mechanism 17. Then, when toner container 2 is detached from holder 3 due to depletion of toner in container body 6, attaching-detaching mechanism 17 of inner cap is activated and inner cap 7 is fitted to the inner side of aperture 5, thereby spill out of remaining toner from aperture 5 may be prevented at exchanging the container body 6. Further, enlarged aperture 12 of aperture 5 may increase the operating accuracy to fit inner cap 7 to inner side of aperture 5, thus occurrence of fitting failure may be prevented.

<Second Aspect>

Figure 7:
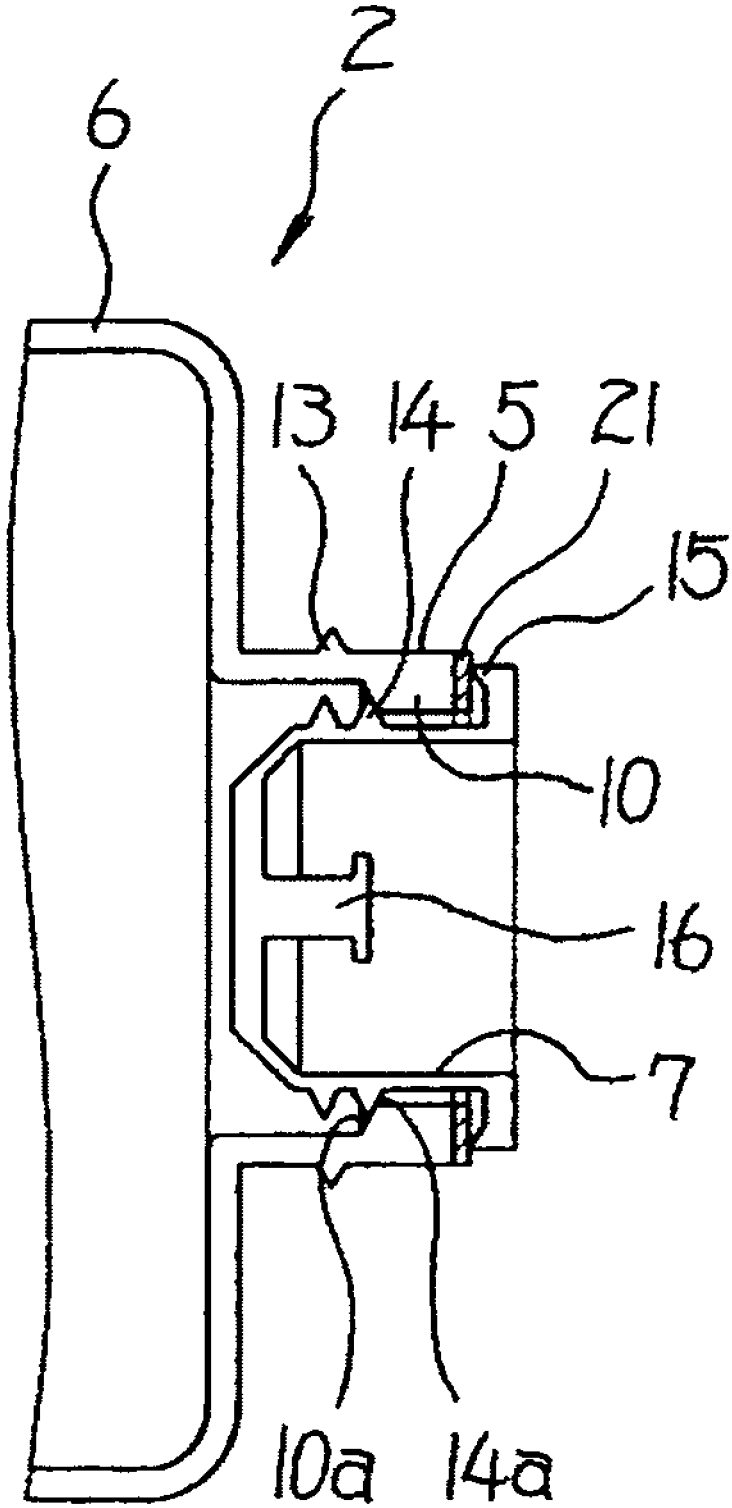
FIG. 7 is a longitudinal front section of an exemplary toner container of the second aspect according to the present invention.

The second aspect of the present invention will be explained with reference to FIG. 7. Reference numbers are the same as those of FIGS. 1 to 4 when the parts are substantially the same.

The construction of the container of the second aspect is substantially the same as that of first aspect, except that sealing face 21 at tip side of aperture 5 is formed of elastic material such as polyurethane. The sealing face 21 of elastic material is fabricated into ring-like, and fixed at tip side of aperture 5.

In such a construction, resilient sealing portion 15 of inner cap 7 cuts into sealing face 21, thereby the sealing ability between sealing face 21 and resilient sealing portion 15 may be enhanced, in the case that outer cap 8 is fitted to outer side of aperture 5 and also in the case that outer cap 8 is released from the aperture 5.

<Third Aspect>

Figure 8:
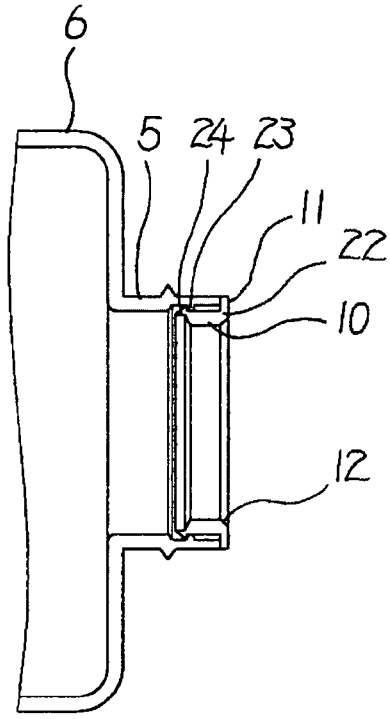
FIG. 8 is a longitudinal front section showing a condition that an aperture portion of a toner container of the third aspect is fitted with a spacer member.
Figure 9:
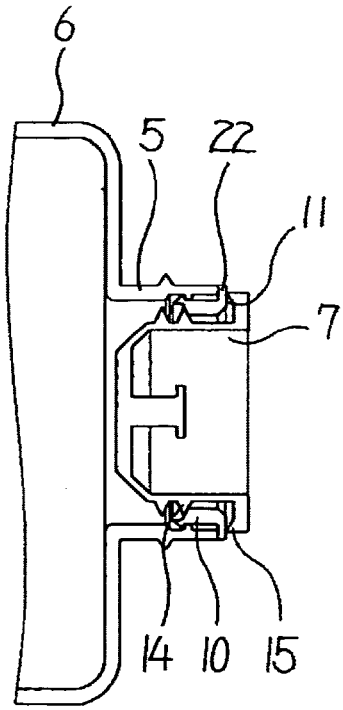
FIG. 9 is a longitudinal front section showing a condition that a spacer member is fitted with an inner cap.

The third aspect of the present invention will be explained with reference to FIGS. 8 and 9. The construction of the container of the third aspect is substantially the same as that of first aspect, except that spacer member 22 is fitted to inner side of aperture 5, and first convex 10, sealing face 11, and enlarged aperture 12 are formed on spacer member 22.

Spacer member 22 is formed of a material such as polycarbonate having a hardness higher than that of polyester etc. that forms aperture 5 and container body 6 etc. Spacer member 22 does not require to possess an attachable and detachable property against aperture 5, therefore may be firmly fitted to inner side of aperture 5, by engaging convex 23 of inner side of aperture 5 and claw 24 of spacer member.

Separate formations of aperture 5 and spacer member 22, and formations of ring-like first convex 10 and enlarged aperture 12 onto spacer member may make ease the formation of container body 6. Further, formation of first convex 10 onto spacer member 22 of hard material may enhance the dimensional accuracy of first convex 10, thereby the sealing ability may be improved when side 14*a* of second convex 14 and side 10*a* of first convex 10 are contacted and pressed. Further, spacer member 22 with first convex 10 is formed of materials having a hardness higher than that of container body, thereby toner leakage caused by deformation and/or shrinkage of first convex 10 may be prevented after the formation.

<Fourth Aspect>

Figure 10:
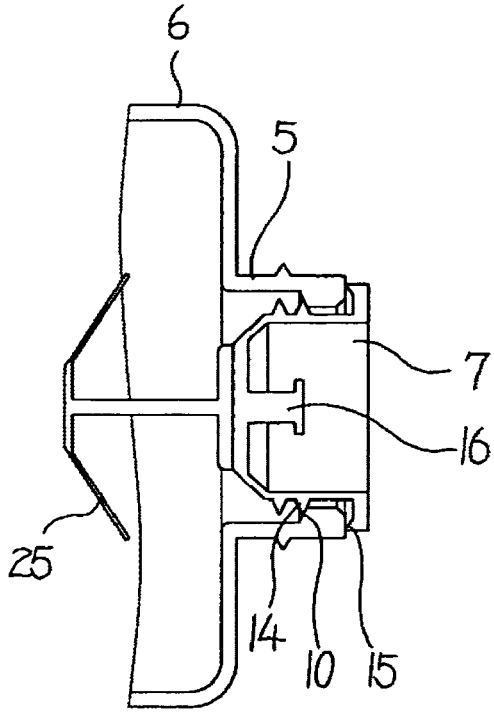
FIG. 10 is a longitudinal front section of an exemplary toner container of the fourth aspect according to the present invention.

The fourth aspect of the present invention will be explained with reference to FIG. 10. In the fourth aspect, anchor member 25 is provided to each bottom face of inner cap 7 in each aspect described before. Anchor member 25 extends into container body 6 when inner cap 7 is fitted to inner side of aperture 5. Further, anchor member 25 is arranged to engage with the edge of aperture 5 of container body 6, when inner cap 7 is pulled toward opening side of aperture 5 by attaching-detaching mechanism 17, then the fitting of aperture 5 to inner side is released and the inner cap separates beyond a predetermined distance apart from the aperture.

In such a construction, when inner cap 7 moves in a direction separating from container body 6 by some reason, after the fitting of aperture 5 to inner side is released, caused by inner cap 7 of toner container 2 installed in copier 1 being pulled by the attaching-detaching mechanism 17, the detachment of inner cap 7 may properly be prevented because anchor member 25 engages to the edge of aperture 5 of container body 6. Consequently, inner cap 7 may be surely fitted to inner side of aperture 5 when toner container 2 is detached from copier 1 after usage; the spill out of remaining toner may be prevented from the aperture 5 to which inner cap 7 is not fitted when toner container is removed after usage.

<Fifth Aspect>

Figure 11:
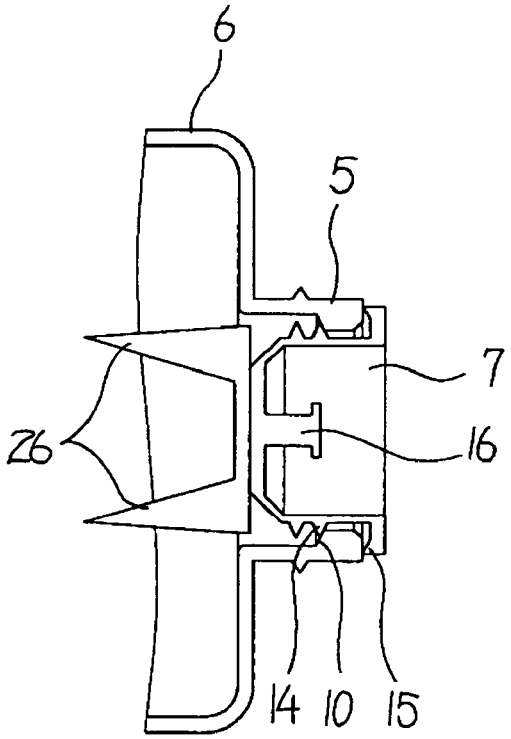
FIG. 11 is a longitudinal front section of an exemplary toner container of the fifth aspect according to the present invention.

The fifth aspect of the present invention will be explained with reference to FIG. 11. In the fifth aspect, contacting piece 26 is provided to each bottom face of inner cap 7 in each aspect described before.

Examples of the material of the contacting piece 26 include polyethylene. Contacting piece 26 extends into container body 6 when inner cap 7 is fitted to inner side of aperture 5. Further, contacting piece 26 is arranged to contact with inner side of aperture 5, when inner cap 7 is pulled toward opening side of aperture 5 by attaching-detaching mechanism 17, the fitting of aperture 5 to inner side is released, and the fitting of inner cap 7 to aperture is released.

In such a construction, when toner container 2 is installed into copier 1 and the fitting of inner cap 7 to aperture 5 is released by attaching-detaching mechanism 17 provided in copier 1, contacting piece 26 contacts with inner side of aperture 5. Therefore, when toner container 2 is rotated around the centerline of toner container in order to feed the toner to the developing portion of the image forming apparatus, the contacting piece 26 that contacts with inner side of aperture 5 relatively contacts and slides with the inner side of aperture 5, thus the toner on the inner side of aperture 5 is scraped off. Consequently, the toner adhered on the inner side of aperture 5, which will be discarded previously, may be decreased effectively.

(Image Forming Apparatus and Image Forming Process)

The image forming apparatus according to the present invention comprises a latent electrostatic image bearing member, latent electrostatic image forming unit, developing unit, transferring unit and fixing unit, and may further comprise an attaching-detaching mechanism of inner cap and the other units, for example, charge-eliminating unit, cleaning unit, recycling unit and control unit, if required.

The image forming process according to the present invention comprises a latent electrostatic image forming step, developing step, transferring step and fixing step, and may further comprise the other steps, for example, a charge-eliminating step, cleaning step, recycling step and control step, if required.

The image forming apparatus according to the present invention preferably comprises an attaching-detaching mechanism of inner cap that releases the fitting of inner cap when the toner container is installed to the image forming apparatus and sustain the inner cap inside the image forming apparatus, and attaches the inner cap so as to fit to the aperture when the toner in the container is consumed and the container is removed from the image forming apparatus. Such an attaching-detaching mechanism of inner cap is described in U.S. Pat. No. 5,822,663.

The image forming process according to the present invention may be suitably applied to the image forming apparatus according to the present invention. The latent electrostatic image forming step may be performed by the latent electrostatic image forming unit, the developing step may be performed by the developing unit, the transferring step may be performed by the transferring unit, and the fixing step may be performed by the fixing unit. The other unit may perform the other steps.

(Latent Electrostatic Image Forming Step and Latent Electrostatic Image Forming Step)

The latent electrostatic image forming step is one that forms a latent electrostatic image on the latent electrostatic image bearing member.

The latent electrostatic image bearing member (hereinafter referring to "photoconductor") is not particularly limited as to the material, shape, construction or size, and may be suitably selected from among those known in the art. For example, its shape may be drum-like, and its material may be that of an inorganic photoconductor, such as amorphous silicon or selenium, or an organic photoconductor such as polysilane or phthalocyanine.

Among these, amorphous silicon is preferred from the viewpoint of long life.

The latent electrostatic image may be formed, for example, by uniformly charging the surface of the latent electrostatic image bearing member, and irradiating it imagewise, which may be performed by the latent electrostatic image forming unit.

The latent electrostatic image forming unit, for example, comprises a charger which uniformly charges the surface of the latent electrostatic image bearing member, and a light irradiator which exposes the surface of the latent image carrier imagewise.

The charging may be performed, for example, by applying a voltage to the surface of the latent electrostatic image bearing member using the charger.

The charger is not particularly limited and may be suitably selected depending on the application, for example, contact chargers known in the art such as a conductive or semi-conductive roller, brush, film or rubber blade, and non-contact chargers using corona discharge such as corotron and scorotron are exemplified.

As for the charging member, the shape thereof is not specifically limited and can for example be, apart from a roller, a magnetic brush or a fur brush. It can be suitably selected according to a specification or configuration of an image-forming apparatus. When a magnetic brush is employed as the charger, the magnetic brush contains an electrostatic charger formed of various ferrite particles such as Zn—Cu ferrite, a non-magnetic conductive sleeve to support the electrostatic charger, and a magnetic roller contained in the non-magnetic conductive sleeve. When a fur brush is used as a charger, a material of the fur brush is, for example, a fur that becomes conductive by treatment with, for example, carbon, copper sulfide, a metal or a metal oxide, and the fur is coiled or mounted to a metal or another core rod which becomes conductive by treatment.

The light irradiation may be performed by irradiating the surface of the latent electrostatic image bearing member imagewise, using the light irradiator for example.

The light irradiator is not particularly limited and may be suitably selected depending on the application provided that it may expose the surface of the latent electrostatic image bearing member charged by the charger in the same way as the image to be formed, for example, a light irradiator such as copy optical system, rod lens array system, laser optical system and liquid crystal shutter optical system may be exemplified.

In addition, in the present invention, a backlight system may be employed wherein the latent electrostatic image bearing member is exposed imagewise from its rear surface.

(Developing Process and Developing Unit)

The developing step is one that develops a latent electrostatic image using the toner supplied from the toner container according to the present invention to form a visible image.

The visible image may be formed for example by developing the latent electrostatic image using the toner or developer, which may be performed by the developing unit.

The developing unit is not particularly limited provided that it may develop an image for example by using the toner or developer, and may be suitably selected from among those known in the art. Examples are those which comprise an image-developer housing the toner, and which may supply the toner with contact or without contact to the latent electrostatic image.

In the image-developer, the toner and the carrier may for example be mixed and stirred together. The toner is thereby charged by friction, and forms a magnetic brush on the surface of the rotating magnet roller. Since this magnet roller is arranged near the latent electrostatic image bearing member (photoconductor), part of the toner in the magnetic brush formed on the surface of this magnet roller moves to the surface of this latent electrostatic image bearing member (photoconductor) due to the force of electrical attraction. As a result, the latent electrostatic image is developed by this toner, and a visible toner image is formed on the surface of this latent electrostatic image bearing member (photoconductor).

(Transferring Step and Transferring Unit)

The transferring step is one that transfers the visible image to a recording medium. In a preferred aspect, the first transferring is performed wherein, using an intermediate image-transfer member, the visible image is transferred to the intermediate image-transfer member, and the second transferring is then performed wherein this visible image is transferred to a recording medium. In a more preferred aspect, using toner of two or more colors and preferably full color toner, the primary transferring step transfers the visible image to the intermediate image-transfer member to form a compounded transfer image, and the second transferring step transfers this compounded transfer image to the recording medium.

The transferring can be realized, for example, by charging the latent electrostatic image bearing member (photoconductor) using a transferring charger, which can be performed by the transferring unit. In a preferred aspect, the transferring unit comprises a first transferring unit which transfers the visible image to the intermediate image-transfer member to form a compound transfer image, and a second transferring unit which transfers this compounded transfer image to the recording medium.

The intermediate image-transfer member is not particularly limited and may be suitably selected from transfer bodies known in the art, for example, a transfer belt may be exemplified.

The transferring unit of the first transferring unit and the second transferring unit preferably comprises an image-transferer which charges by releasing the visible image formed on the latent electrostatic image bearing member or photoconductor to the recording-medium side. There may be one, two or more of the transferring unit.

The image-transferer may be a corona transferring unit which functions by corona discharge, a transferring belt, a transferring roller, a pressure transferring roller or an adhesion transferring unit.

The recording medium is not particularly limited and may be suitably selected from among recording media or recording papers known in the art.

The recording medium is typically plain paper, but is not specifically limited, may be selected depending on the application and includes, for example, a polyethylene terephthalate (PET) base for overhead projector (OHP).

The fixing step is one that fixes the visible image transferred to the recording medium using a fixing apparatus. This may be carried out for developer of each color transferred to the recording medium, or in one operation when the developers of each color have been laminated.

The fixing apparatus is not particularly limited and may be suitably selected from heat and pressure unit known in the art. Examples of heat and pressure unit include a combination of a heat roller and pressure roller, and a combination of a heat roller, pressure roller and endless belt.

The heating temperature in the heat-pressure unit is preferably 80° C. to 200° C.

Also, in the present invention, an optical fixing unit known in the art may be used in addition to or instead of the fixing step and fixing unit, depending on the application.

The charge-eliminating step is one that applies a discharge bias to the latent electrostatic image bearing member to discharge it, which may be performed by a charge-eliminating unit.

The charge-eliminating unit is not particularly limited and may be suitably selected from charge-eliminating unit known in the art provided that it can apply a discharge bias to the latent electrostatic image bearing member, for example, a discharge lamp.

The cleaning step is one that removes electrophotographic toner remaining on the latent electrostatic image bearing member, and may be performed by a cleaning unit.

The cleaning unit is not particularly limited and may be suitably selected from cleaning unit known in the art provided that it can remove electrophotographic toner remaining on the latent electrostatic image bearing member, for example, a magnetic brush cleaner, electrostatic brush cleaner, magnetic roller cleaner, blade cleaner, brush cleaner and web cleaner are exemplified.

The recycling step is one that recycles the electrophotographic toner removed by the cleaning step to the developing step, and may be performed by a recycling unit.

The recycling unit is not particularly limited and may be suitably selected from among transport unit known in the art.

The control step is one that controls the respective processes, and may be properly implemented by a control unit.

The control unit is not particularly limited and may be suitably selected depending on the application provided that it can control the operation of each of the unit, for example, a device such as a sequencer or a computer.

An embodiment of the image forming process of the present invention using the image forming apparatus according to the present invention will be illustrated with reference to FIG. 12. The image forming apparatus 100 shown in FIG. 12 comprises photoconductor drum 110 (hereinafter briefly referred to as "photoconductor 110") as the latent electrostatic image bearing member, charging roller 120 as the charging unit, light irradiator 30 as the exposing unit, image-developer 40 as the developing unit, intermediate image-transfer member 50, cleaner 60 serving as the cleaning unit and having a cleaning blade, and charge-eliminating lamp 70 as the charge-eliminating unit.

The intermediate image-transfer member 50 is an endless belt, being designed such that it is spanned over three rollers 51 and driven in the direction indicated by an arrow. One of the three rollers 51 serves as a bias roller for applying a bias for image transfer to the intermediate image-transfer member 50. A cleaner 90 for cleaning the intermediate image-transfer member 50 is arranged in the vicinity of the intermediate image transfer member 50 and includes a cleaning blade. A transferring roller 80 as the transferring unit faces the intermediate image-transfer member 50 and transfers a toner image from the intermediate image-transfer member 50 to a transferring sheet 95 serving as a final transferring member. A corona charger 58 for applying charges onto the developed image on the intermediate image-transfer member 50 is arranged around the intermediate image-transfer member 50. The corona charger is disposed between a contact area of the photoconductor 110 and the intermediate image-transfer member 50 and another contact area of the intermediate image-transfer member 50 and the transfer sheet 95 in the direction of rotation of the intermediate image-transfer member 50.

The image-developer 40 is comprised of a developing belt 41 as a developer carrier, black developing unit 45K disposed around the developing belt 41, yellow developing unit 45Y, magenta developing unit 45M and cyan developing unit 45C. The black developing unit 45K includes a developer tank 42K, developer feed roller 43K and developing roller 44K. The yellow developing unit 45Y includes a developer tank 42Y, developer feed roller 43Y and developing roller 44Y. The magenta developing unit 45M includes a developer tank 42M, developer feed roller 43M and developing roller 44M. The cyan developing unit 45C includes a developer tank 42C, developer feed roller 43C and developing roller 44C. The developing belt 41 is in the form of an endless belt and is spanned over plural belt rollers rotatably, a part of which is in contact with the photoconductor 110.

Figure 12:
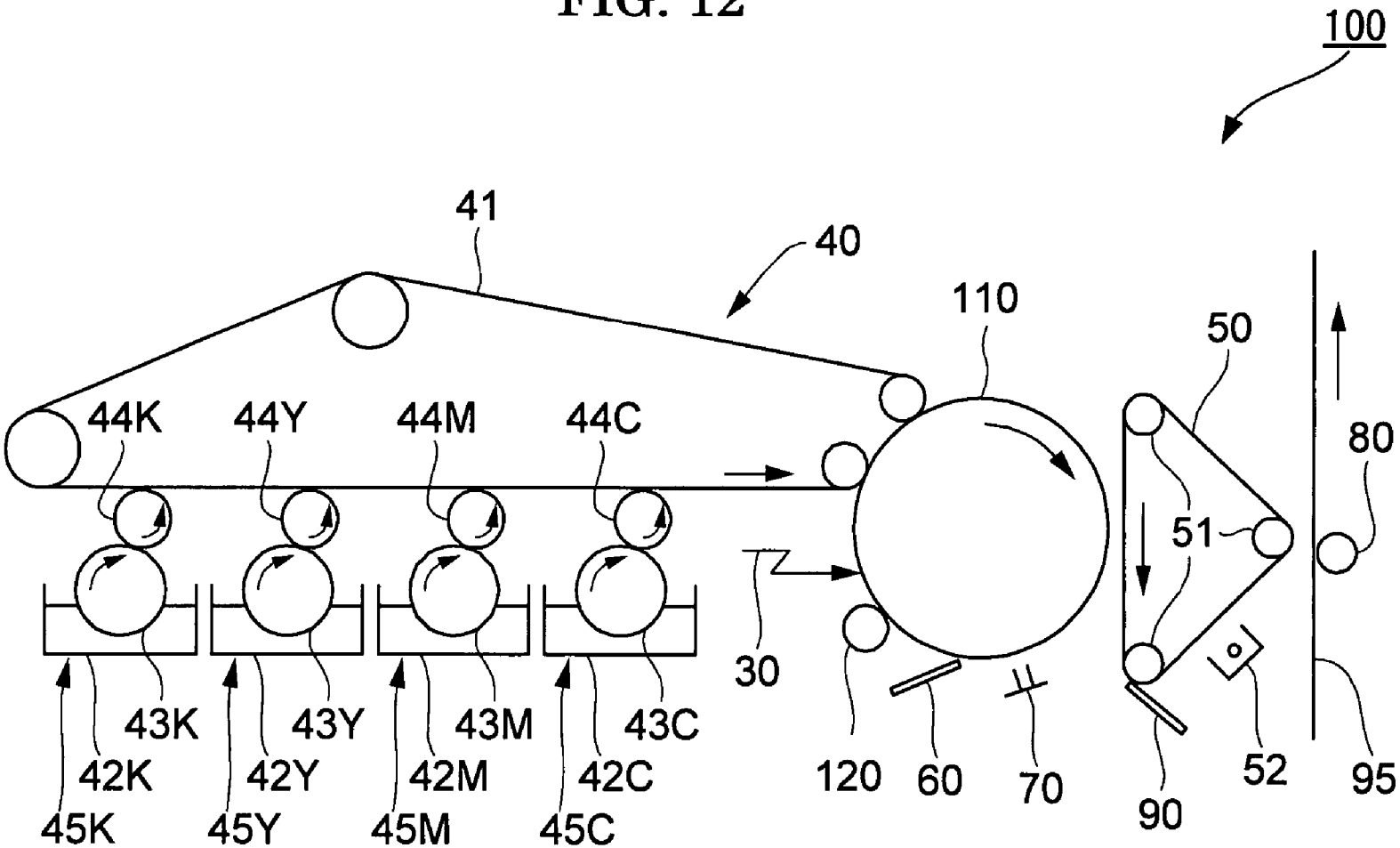
FIG. 12 is a schematic exemplary view that shows an inventive image forming process by means of an inventive image forming apparatus.

In the image forming apparatus 100 shown in FIG. 12, for example, the charging roller 120 uniformly charges the photoconductor 110. The light irradiator 30 applies light to the photoconductor 110 imagewise to form a latent electrostatic image thereon. The image-developer 40 feeds the developer to the photoconductor 110 to thereby develop the latent electrostatic image thereon to form a visible image. The visible image is transferred (primary transferring) to the intermediate image-transfer member 50 and then transferred (secondary transferring) to the transferring sheet 95 by action of a voltage applied by the rollers 51, to thereby form a transferred image on the transferring sheet 95. Untransferred developers on the photoconductor 110 after the transferring procedure are removed by the cleaner 60, followed by elimination of residual charges by the charge eliminating lamp 70 to be subjected to another charging procedure.

Figure 13:
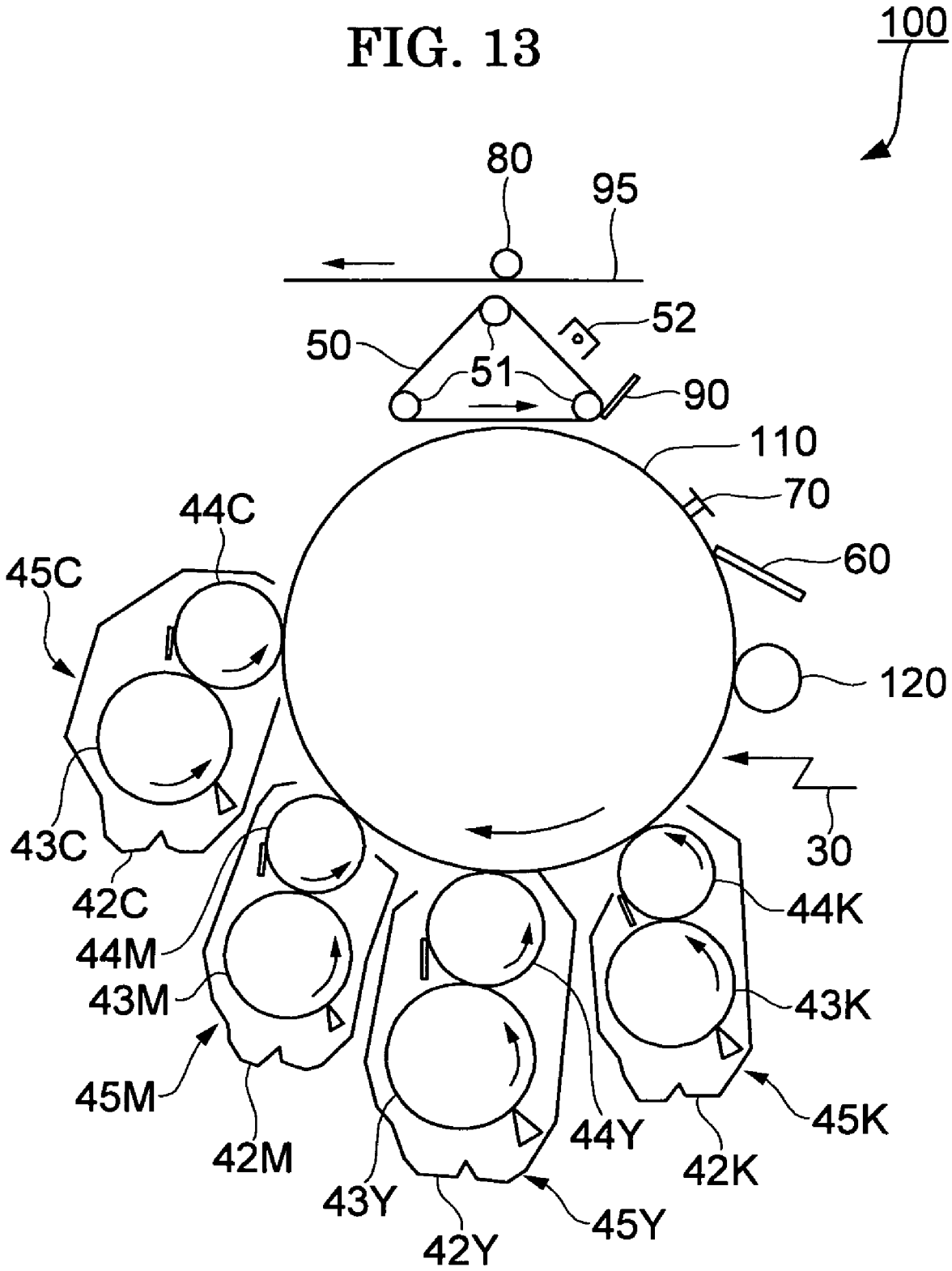
FIG. 13 is another schematic exemplary view that shows an inventive image forming process by means of an inventive image forming apparatus.

Another embodiment of the image forming process using the image forming apparatus will be illustrated with reference to FIG. 13. The image forming apparatus 100 of FIG. 13 has the same configuration and the same advantages as in the image forming apparatus 110 of FIG. 12, except that the image forming apparatus 100 of FIG. 13 does not include a developing belt 41, and that a black developing unit 45K, yellow developing unit 45Y, magenta developing unit 45M and cyan developing unit 45C surround and directly face a photoconductor 110. The same components of FIG. 13 as those of FIG. 12 have the same reference numerals, respectively.

Figure 14:
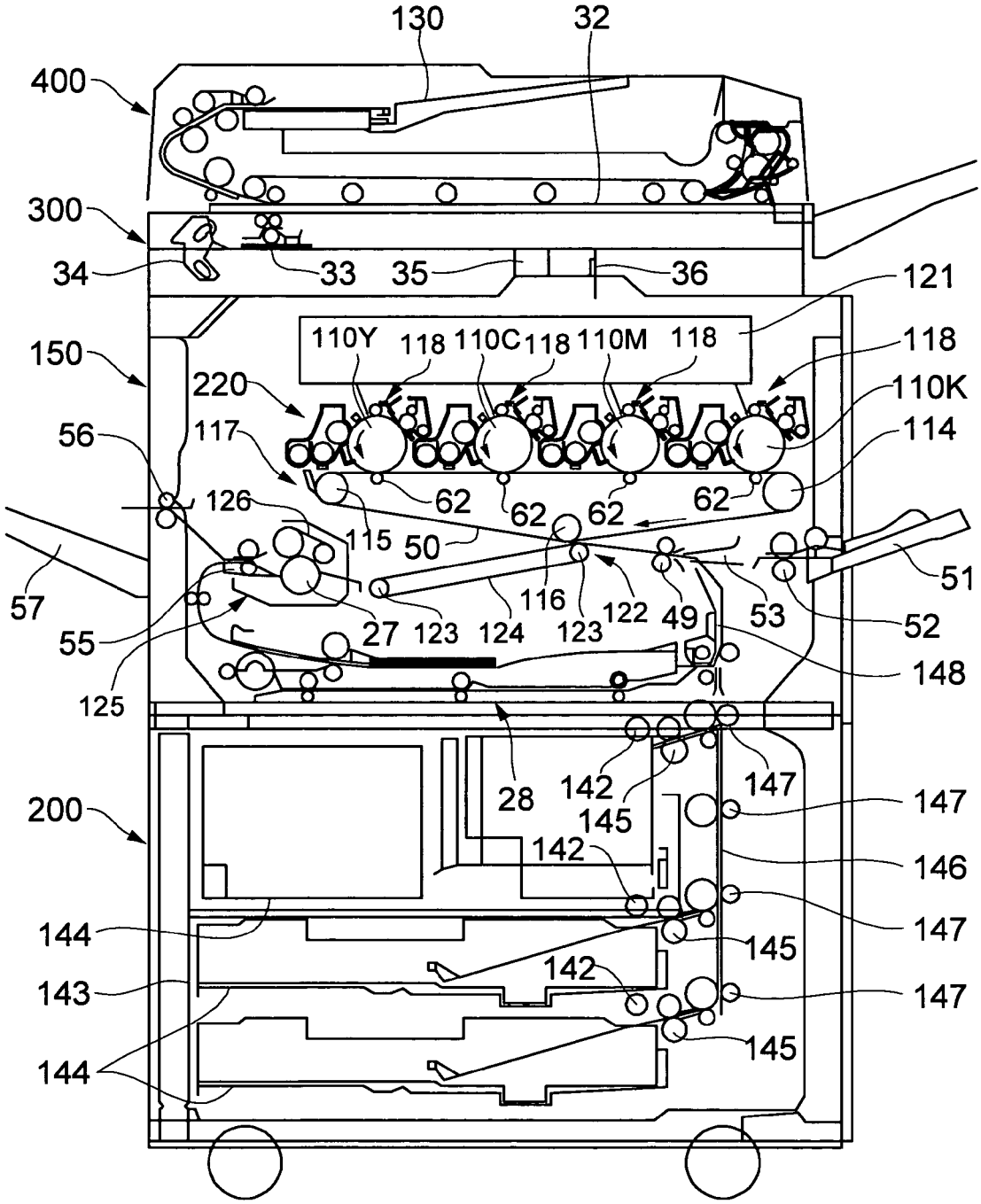
FIG. 14 is a schematic exemplary view that shows an inventive image forming process by means of an inventive image forming apparatus of tandem type color apparatus.

The image forming apparatus 100 shown in FIG. 14 is a tandem color image forming apparatus which includes a copier main body 150, feeder table 200, scanner 300 and automatic document feeder (ADF) 400.

The copier main body 150 includes an endless-belt intermediate image-transfer member 50 at its center part. The intermediate image-transfer member 50 is spanned over three support rollers 114, 115 and 116 and is capable of rotating and moving in a clockwise direction in FIG. 14. An intermediate image-transfer member cleaner 117 is arranged in the vicinity of the second support roller 115. The intermediate image-transfer member cleaner 117 is capable of removing a residual toner from the intermediate image-transfer member 50 after image transfer. Above the intermediate image-transfer member 50 spanned between the first and second support rollers 114 and 115, yellow, cyan, magenta and black image forming devices 118 are arrayed in parallel in a moving direction of the intermediate image-transfer member 50 to thereby constitute a tandem image forming unit 220. A light irradiator 121 is arranged in the vicinity of the tandem image forming unit 220. A secondary image-transferer 122 faces the tandem image-developer 220 with the interposition of the intermediate image-transfer member 50. The secondary image-transferer 122 comprises an endless belt serving as a secondary transferring belt 124 spanned over two rollers 123. The transferring sheet transported on the secondary transferring belt 124 is capable of being in contact with the intermediate image-transfer member 50. An image-fixer 125 is arranged on the side of the secondary image-transferer 122. The image-fixer 125 comprises an endless image-fixing belt 126 and a pressure roller 127 pressed on the image-fixing belt 126.

The tandem image forming apparatus further includes a sheet reverser 28 in the vicinity of the secondary image-transferer 122 and the image-fixer 125. The sheet reverser 28 is capable of reversing the transferring sheet so as to form images on both sides of the transferring sheet.

A full-color image (color copy) is formed by using the tandem image forming apparatus 220 in the following manner. Initially, a document is placed on a document platen 130 of the automatic document feeder (ADF) 400. Alternatively, the automatic document feeder 400 is opened, the document is placed on a contact glass 32 of the scanner 300, and the automatic document feeder 400 is closed to press the document.

When pushing a starting switch (not shown), the document placed on the automatic document feeder 400 is transported onto the contact glass 32. When the document is initially placed on the contact glass 32, the scanner 300 is immediately driven to operate a first carriage 33 and a second carriage 34. Light is applied from a light source to the document by action of the first carriage 33, and reflected light from the document is further reflected toward the second carriage 34. The reflected light is further reflected by a mirror of the second carriage 34 and passes through an image-forming lens 35 into a read sensor 36 to thereby read the color document (color image) and to produce black, yellow, magenta and cyan image information.

Each of the black, yellow, magenta and cyan image information is transmitted to each of the image forming devices 118 (black, yellow, magenta and cyan image forming devices) in the tandem image forming apparatus 220 to thereby form black, yellow, magenta and cyan toner images therein. Specifically, each of the image forming devices 118 (black, yellow, magenta and cyan image forming devices) in the tandem image forming apparatus 220 has a photoconductor 110 (black photoconductor 110K, yellow photoconductor 110Y, magenta photoconductor 110M or cyan photoconductor 110C), an electrostatic charger 60, a light irradiator, a image-developer 61, a transferring charger 62, a photoconductor cleaner 63, and a charge-eliminator 64 and can form a monochrome image (black, yellow, magenta or cyan image) based on the color image information. The charger 60 serves to charge the photoconductor uniformly. The light irradiator applies light to the photoconductor color-imagewise based on each color image information to thereby form a latent electrostatic image corresponding to the color image. The image-developer 61 develops the latent electrostatic image with a color developer (black, yellow, magenta or cyan developer) to thereby form a visible image. The transferring charger 62 transfers the visible image to the intermediate image-transfer member 50. The black image formed on the black photoconductor 110K, the yellow image formed on the yellow photoconductor 110Y, the magenta image formed on the magenta photoconductor 110M and the cyan image formed on the cyan photoconductor 110C are sequentially transferred (primary transferring) and superimposed onto the intermediate image-transfer member 50 rotated and shifted by the support rollers 114, 115 and 116. Thus, a composite color image (transferred color image) is formed.

One of feeder rollers 142 of the feeder table 200 is selectively rotated, sheets are ejected from one of multiple feeder cassettes 144 in a paper bank 143 and are separated by a separation roller 145 one by one into a feeder path 146, are transported by a transport roller 147 into a feeder path 148 in the copier main body 150 and are bumped against a resist roller 49. Alternatively, a feeder roller 150 is rotated to eject sheets on a manual bypass tray 51, the sheets are separated one by one by a separation roller 52 into a manual bypass feeder path 53 and are bumped against the resist roller 49. The resist roller 49 is generally grounded but can be used under the application of a bias to remove paper dust of the sheets.

The resist roller 49 is rotated synchronously with the movement of the composite color image on the intermediate image-transfer member 50 to transport the sheet (recording paper) into between the intermediate image-transfer member 50 and the secondary image-transferer 122, and the composite color image is transferred onto the sheet by action of the secondary image-transferer 122 to thereby transfer the color image to the recording sheet. Separately, the intermediate image-transfer member cleaner 17 removes residual developers on the intermediate image-transfer member 50 after image transfer.

The sheet (recording sheet) bearing the transferred color image is transported by the secondary image-transferer 122 into the image-fixer 125, is applied with heat and pressure in the image-fixer 125 to fix the transferred color image. The sheet then changes its direction by action of a switch blade 55, is ejected by an ejecting roller 56 and is stacked on an output tray 57. Alternatively, the sheet changes its direction by action of the switch blade 55 into the sheet reverser 28, turns therein, is transported again to the transfer position, followed by image formation on the backside of the sheet. The sheet bearing images on both sides thereof is ejected through the ejecting roller 56 onto the output tray 57.

In accordance with the container of the present invention, an inner is fitted to inner side of the aperture and an outer cap is fitted to outer side of the aperture; then a resilient sealing portion of the inner cap that contacts with the sealing face of the aperture is pressed and compacted or thinned by the pressing portion of the outer cap; thereby the sealing ability between the sealing face and the resilient sealing portion is enhanced, the leakage of the content in the container body may be effectively prevented.

In addition, when the fitting of the outer cap is released, the resilient sealing portion that is compacted or thinned by the action of pressing portion recovers from the compacted or thinned condition; the resilient force of the recovered sealing portion urges the inner cap to move and the side of the second convex and the side of the first convex are contacted and pressed, thus the sealing effect owing to the contacted and pressed condition may prevent the leakage of the content from the aperture.

In accordance with the toner container of the present invention, an inner is fitted to inner side of the aperture and an outer cap is fitted to outer side of the aperture; then a resilient sealing portion of the inner cap that contacts with the sealing face of the aperture is pressed and thinned by the pressing portion of the outer cap; thereby the sealing ability between the sealing face and the resilient sealing portion is enhanced, the leakage of the toner in the container body may be effectively prevented.

In addition, when the fitting of the outer cap is released, the resilient sealing portion that is compacted or thinned by the action of pressing portion recovers from the compacted or thinned condition; the resilient force of the recovered sealing portion urges the inner cap to move and the side of the second convex and the side of the first convex are contacted and pressed, thus the sealing effect owing to the contacted and pressed condition may prevent the leakage of the toner from the aperture.

In accordance with the image forming apparatus and image forming process of the present invention, the leakage of toner may be effectively prevented at installing the toner container to the image forming apparatus, and also the smears due to leaked toner may be effectively prevented inside the image forming apparatus, since the toner container of the present invention is utilized.

What is claimed is:

1. A container comprising:

a container body having a pipe-like aperture, an inner cap fitted to inner side of the aperture in an attachable and detachable fashion, and an outer cap fitted to outer side of the aperture in an attachable and detachable fashion, wherein the aperture is equipped with a first convex that projects ring-wise from the inner side of the aperture and a sealing face that is situated at tip side of the aperture, wherein the inner cap is equipped with a second convex and a resilient sealing portion, the second convex projects ring-wise from the outer side of the inner cap and has an outer diameter larger than the inner diameter of the first convex, the resilient sealing portion contacts with the sealing face resiliently from outside of the aperture to urge the inner cap in a direction so that the second convex presses the first convex, and wherein the outer cap is equipped with a pressing portion that presses the resilient sealing portion so as to move the inner cap to a position where the pressing are released between the first convex and the second convex.

2. The container according to claim 1, wherein the outer diameter D (mm) of the second convex and the inner diameter d (mm) of the first diameter satisfy the following relation: 0.05 mm≦D−d≦1.5 mm.

3. The container according to claim 1, wherein at least one of the face of the second convex and the face of the first convex is formed into one of tapered face and round face.

4. The container according to claim 1, wherein the sealing face is formed of resilient material.

5. The container according to claim 1, wherein the inner cap is subjected to annealing.

6. The container according to claim 1, wherein the aperture comprises a spacer member having the first convex.

7. The container according to claim 1, wherein the aperture comprises an enlarged aperture at the inner side that enlarges gradually toward the sealing face.

8. The container according to claim 1, wherein the inner cap comprises an anchor member that inhibits the inner cap, released from the aperture, to separate beyond a predetermined distance apart from the aperture by engaging with the edge of the aperture.

9. The container according to claim 1, wherein the content in the container is one selected from the group consisting of toner, developer, and powder for image forming.

10. A container containing a toner, comprising:

a container body having a pipe-like aperture, an inner cap fitted to inner side of the aperture in an attachable and detachable fashion, and an outer cap fitted to outer side of the aperture in an attachable and detachable fashion, wherein the toner is filled into the container body, wherein the aperture is equipped with a first convex that projects ring-wise from the inner side of the aperture and a sealing face that is situated at tip side of the aperture, wherein the inner cap is equipped with a second convex and a resilient sealing portion, the second convex projects ring-wise from the outer side of the inner cap and has an outer diameter larger than the inner diameter of the first convex, the resilient sealing portion contacts with the sealing face resiliently from outside of the aperture to urge the inner cap in a direction so that the second convex presses the first convex, and wherein the outer cap is equipped with a pressing portion that presses the resilient sealing portion so as to move the inner cap to a position where the pressing are released between the first convex and the second convex.

11. The container containing a toner according to claim 10, wherein the outer diameter D (mm) of the second convex and the inner diameter d (mm) of the first diameter satisfy the following relation: 0.05 mm≦D−d≦1.5 mm.

12. The container containing a toner according to claim 10, wherein at least one of the face of the second convex and the face of the first convex is formed into one of tapered face and round face.

13. The container containing a toner according to claim 10, wherein the sealing face is formed of resilient material.

14. The container containing a toner according to claim 10, wherein the inner cap is subjected to annealing.

15. The container containing a toner according to claim 10, wherein the aperture comprises a spacer member having the first convex.

16. The container containing a toner according to claim 10, wherein the aperture comprises an enlarged aperture at the inner side that enlarges gradually toward the sealing face.

17. The container containing a toner according to claim 10, wherein the inner cap comprises an anchor member that inhibits the inner cap, released from the aperture, to separate beyond a predetermined distance apart from the aperture by engaging with the edge of the aperture.

18. The container containing a toner according to claim 10, wherein the container is installed to an image forming apparatus in an attachable and detachable fashion.

19. The container containing a toner according to claim 18, wherein the inner cap comprises a contacting piece, and the contacting piece contacts with the inner side of the aperture when the fitting of the inner cap to the aperture of the container body installed to an image forming apparatus is released by an attaching-detaching mechanism of inner cap provided in the image forming apparatus.

20. An image forming apparatus comprising:

a photoconductor, a latent electrostatic image forming unit configured to form an electrostatic image on the photoconductor, a developing unit configured to develop the latent electrostatic image by means of a toner to form a visible image, a transferring unit configured to transfer the visible image on a recording medium, and a fixing unit configured to fix the transferred image on the recording medium, wherein the toner is supplied from a container containing the toner, the container comprises a container body having a pipe-like aperture, an inner cap fitted to inner side of the aperture in an attachable and detachable fashion, and an outer cap fitted to outer side of the aperture in an attachable and detachable fashion, wherein the aperture is equipped with a first convex that projects ring-wise from the inner side of the aperture and a sealing face that is situated at tip side of the aperture, wherein the inner cap is equipped with a second convex and a resilient sealing portion, the second convex projects ring-wise from the outer side of the inner cap and has an outer diameter larger than the inner diameter of the first convex, the resilient sealing portion contacts with the sealing face resiliently from outside of the aperture to urge the inner cap in a direction so that the second convex presses the first convex, and wherein the outer cap is equipped with a pressing portion that presses the resilient sealing portion so as to move the inner cap to a position where the pressing are released between the first convex and the second convex.

21. The image forming apparatus according to claim 20, wherein the image forming apparatus comprises an attaching-detaching mechanism of inner cap that detaches the fitting of inner cap when the container containing the toner is installed to the image forming apparatus and sustains the inner cap inside the image forming apparatus, and attaches the inner cap so as to fit to the aperture when the toner in the container is consumed and the container is removed from the image forming apparatus.

22. An image forming process, comprising:

forming a latent electrostatic image on a photoconductor surface, developing the latent electrostatic image to form a visible image by means of a toner, transferring the visible image on a recording medium, and fixing the image transferred on the recording medium, wherein the toner is supplied from a container containing the toner, the container comprises a container body having a pipe-like aperture, an inner cap fitted to inner side of the aperture in an attachable and detachable fashion, and an outer cap fitted to outer side of the aperture in an attachable and detachable fashion, wherein the aperture is equipped with a first convex that projects ring-wise from the inner side of the aperture and a sealing face that is situated at tip side of the aperture, wherein the inner cap is equipped with a second convex and a resilient sealing portion, the second convex projects ring-wise from the outer side of the inner cap and has an outer diameter larger than the inner diameter of the first convex, the resilient sealing portion contacts with the sealing face resiliently from outside of the aperture to urge the inner cap in a direction so that the second convex presses the first convex, and wherein the outer cap is equipped with a pressing portion that presses the resilient sealing portion so as to move the inner cap to a position where the pressing are released between the first convex and the second convex.

* * * * *